United States Patent [19]

Stilling

[11] Patent Number: 4,690,192

[45] Date of Patent: Sep. 1, 1987

[54] REPLACEABLE AWNING

[76] Inventor: Johann Stilling, 1141 Royal York Road, Apt. A1001, Islington, Ontario, Canada

[21] Appl. No.: 857,158

[22] Filed: Apr. 29, 1986

[51] Int. Cl.[4] ..... A47H 13/00

[52] U.S. Cl. ..... 160/57; 160/395

[58] Field of Search ..... 160/57, 58, 383, 384, 160/386, 39.4, 395, 394, 397, 392; 52/63, 74, 201, 656, 658; 403/401, 402, 297

[56] References Cited

U.S. PATENT DOCUMENTS

| | | | |
|---|---|---|---|
| 2,950,727 | 8/1960 | Dunn | 160/392 |
| 2,986,150 | 5/1961 | Torian | 52/63 |
| 3,143,165 | 8/1964 | Lewis et al. | 160/392 X |
| 3,791,076 | 2/1974 | Gahler | 52/63 |
| 3,909,994 | 10/1975 | Richter | 52/63 |
| 4,485,597 | 12/1984 | Worallo | 403/297 |
| 4,513,554 | 4/1985 | Johnson et al. | 52/657 |

FOREIGN PATENT DOCUMENTS

| | | | |
|---|---|---|---|
| 2054829 | 5/1972 | Fed. Rep. of Germany | 403/297 |

*Primary Examiner*—Ramon S. Britts
*Assistant Examiner*—Cherney S. Lieberman
*Attorney, Agent, or Firm*—George A. Rolston

[57] ABSTRACT

An awning having a modular frame with frame pieces, having longitudinal recesses, junctions joining the frame pieces to form a composite awning frame, flexible plastic panels stretched over the composite frame and fastened in the longitudinal recesses, and, elongated flexible wedging strips shaped to be force-fitted into the recesses together with portions of the flexible panels thereby wedging the portions of the flexible panels and securing them.

6 Claims, 8 Drawing Figures

FIG. 1.
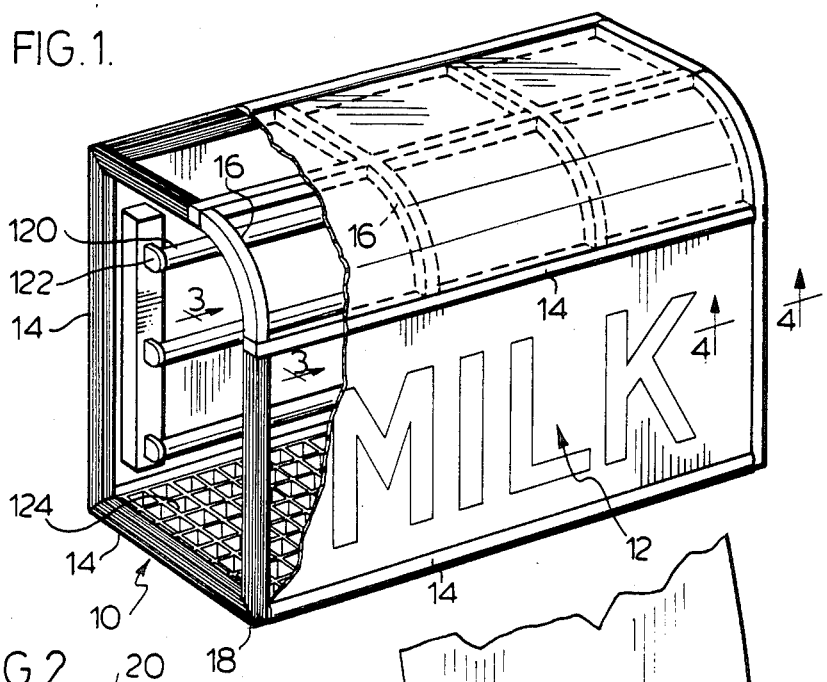
FIG. 2.
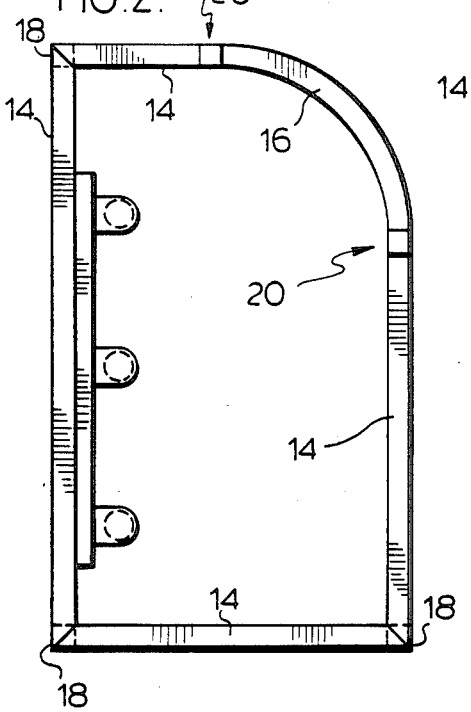
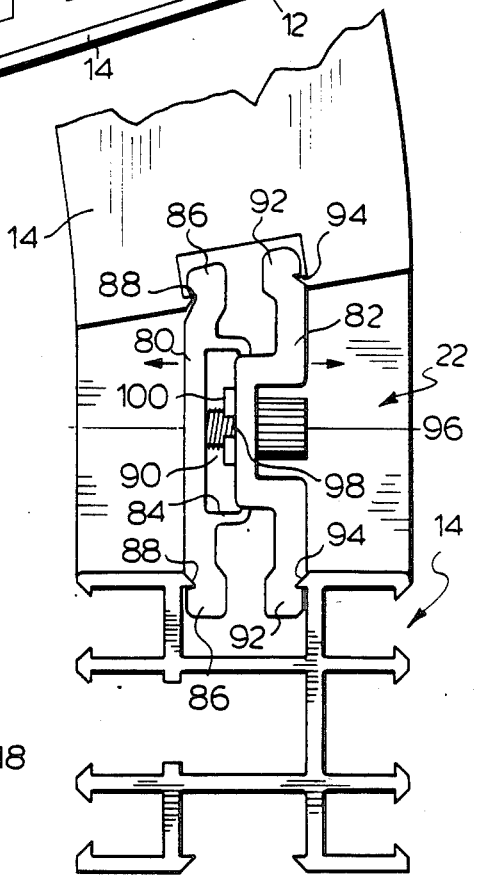
FIG. 3.

FIG. 4.
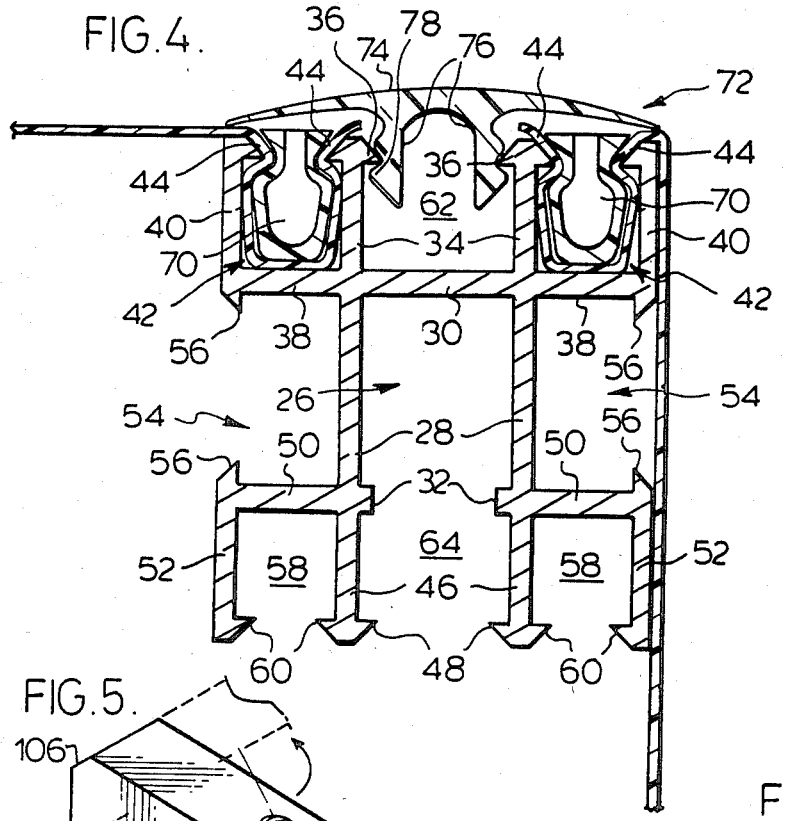
FIG. 5.
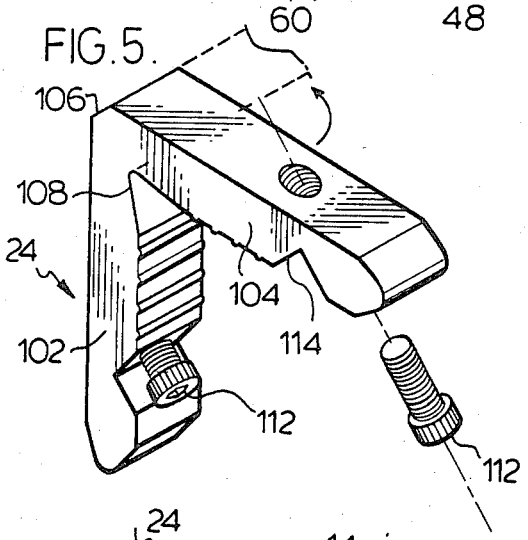
FIG. 7.
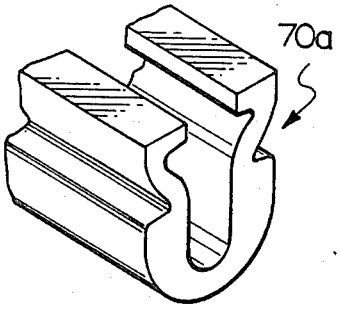
FIG. 6.
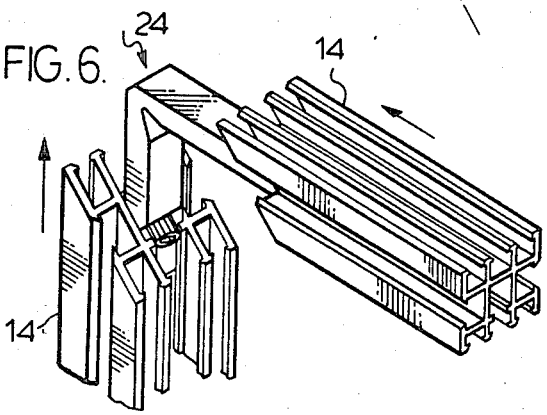
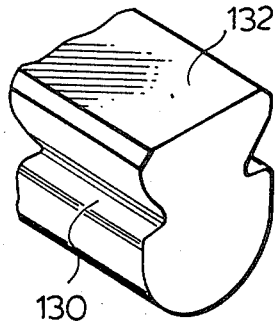
FIG. 8.

REPLACEABLE AWNING

The invention relates to an awning, such as is used as a store front.

BACKGROUND OF THE INVENTION

Awnings are widely used on store fronts, and are often used in place of the conventional, rectangular box-like store front identification panel.

The awning is usually a panel of vinyl material supported on a framework of metal struts or tubes. One popular form of framework is a generally curved convex framework. Other typical frameworks are rectangular, or angled or the like. In some cases the panel is simply stretched out flat within a rectangular framework.

In the majority of cases the framework consisted of struts or tubes which were cut to length, and welded together, and formed by bending or the like into various shapes. The panel of vinyl was then simply stretched over the framework, and fastened on the inside of the framework by various fastening devices. Graphics were often printed on the panel.

This form of construction had numerous inherent disadvantages.

If it was desired to change the graphics on the flexible sign panel, it was necessary in most cases to completely remove the framework, remove the fastening devices, create another fabric panel, fasten it in position, and re-erect the framework.

This was a costly, time consuming operation.

Furthermore, the frameworks were usually made of struts or tubes of steel. Since the awning is located outdoors, rust created problems. The fastenings frequently rusted away from the framework so that the panel became loose. Other kinds of fastenings became immovably fastened to the framework, so that replacement of the sign panel required complete replacement of the framework as well.

The manner of constructing the framework caused a substantial amount of hand labour, involving costly bending operations, cutting to length, welding and the like, all of which resulted in a costly installation.

In some cases, it was desirable to install illuminations underneath the awning. In the past this was usually done by simply installing some form of lighting fixtures and tubes on the building underneath the awning.

This operation would involve the employment of different tradespeople at different times, again leading to considerable extra expense.

Clearly, it is desirable to provide an awning which may be constructed from a kit of components, in a variety of shapes and sizes. In addition, it is clearly desirable to provide some means whereby the flexible panel containhng the graphics can be removed and replaced without the necessity of removing the entire structure.

BRIEF SUMMARY OF THE INVENTION

With a view to overcoming the various disadvantages set out above, the invention comprises an awnng having a modular frame formed of a plurality of frame pieces, at least some of said frame pieces defining longitudinal recesses, and junction means joining said frame pieces, to form a composite awning frame, and a flexible plastic panel, adapted to be stretched over said composite frame, and fastened in said longitudinal recesses, and elongated flexible wedging strips shaped and adapted to be force fitted into said recesses, together with portions of said flexible panel, thereby wedging said portions of said flexible panel in said recesses and securing the same.

More particularly, it is an objective of the invention to provide an awning having the foregoing advantages wherein the frame defines a planar portion, and frame portions around said planar portion on all four sides, and including at least two said flexible plastic panels, one said panel being dimensioned to fit in said planar area, and the other said panel being shaped to fit over the remainder of said frame, thereby permitting replacement of said planar portion without disturbing the remainder.

More particularly, it is an objective of the invention to provide an awning having the foregoing advantages wherein said frame pieces define two continuous spaced apart longitudinal fastening recessed formed therealong in parallel relation.

More particularly, it is an objective of the invention to provide an awning having the foregoing advantages wherein the frame pieces incorporate an intermediate junction recess formed therealong, between said longitudinal recesses, and fastening means in said intermediate recess, permitting connection between adjacent frame pieces.

The various features of novelty which characterize the invention are pointed out with particularity on the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 1 is a front perspective illustration of a typical awning according to the invention, partially cut away and partially exploded;

FIG. 2 is an end elevation of the awning of FIG. 1, with the fabric panel removed;

FIG. 3 is a greatly enlarged detail of the frame of FIG. 1;

FIG. 4 is a greatly enlarged section of the frame along 4—4 of FIG. 1;

FIG. 5 is a greatly enlarged perspective of another form of connector;

FIG. 6 is a schematic partially exploded illustration showing the operation of the connector of FIG. 5;

FIG. 7 is a section of an alternate embodiment of wedging strip; and,

FIG. 8 is a section of an alternate form of fastening strip.

DESCRIPTION OF A SPECIFIC EMBODIMENT

Referring first of all to FIG. 1, it will be seen that this preferred embodiment of the invention is illustrated in the form of a typical awning, as used on a store front.

In this embodiment, the awning comprises a framework indicated generally as 10, and a plurality of flexible plastic panels indicated generally as 12. The framework 10 is in fact formed of a plurality of separate sections or pieces (see below) and the flexible panels are a plurality of separate panel pieces (see below) as will become apparent from the following description.

As shown in FIGS. 1 and 2, the frame 10 of the illustrated embodiment comprises a plurality of individual frame pieces or lengths, namely straight or linear pieces 14, and curved for arcuate pieces 16. The frame pieces are all separate from one another, being cut from a common extrusion (FIG. 4) described below. The various lengths or pieces of frame 14 are joined either end to end in end-abutting relation, or at mitered corners, or at T-shaped junctions. The location of mitered angled junctions is shown as 18, and the location of T-shaped junctions is shown as 20. End-butting junctions are not specifically illustrated, but are described below.

In order to join two frame pieces 14 at T-shaped or end-abutting junctions, a connector portion indicated generally as 22 (FIG. 3) is used. In order to join two frame pieces at a mitered corner 14, an angle junction member 24 (FIGS. 5 and 6) is used.

At corners where three frame pieces join together, then both types of connectors 22 and 24 may be used.

Referring now to FIG. 4, it will be seen that the shape of the frame members 14 is defined as a continuous extrusion. Typically the members will be formed of aluminum, being particularly suitable for fabricating techniques as described herein, and also being resistant to corrosion.

Clearly however the invention is not restricted solely to the use of an aluminum extrusion.

The frame pieces 14 will be seen to define a generally rectangular shape in outline, and having a central three-sided rectangular inner junction channel 26, defined by channel walls 28—28 and 30.

The two walls 28 define an open mouth, partially enclosed by rib portions 32, giving access to the channel 26 from the exterior.

On the outer side of channel wall 30, a further channel is defined by side walls 34, which extend away from wall 30, on axes common with the side walls 28. Ridge portions 36 partially enclose the open mouth defined by the two walls 34. At the junction between walls 28 and 30, walls 38 extend outwardly, normal to walls 28, and are located along an axis common with that of wall 30. Side walls 40 extend from the free ends of walls 38 at right angles thereto, thereby defining further channels 42, having open mouths partially defined by ridges 44.

From the free ends of walls 28, two further channel side walls 46 extend away therefrom along spaced apart parallel axes common with the axis of walls 28, and define an open mouth partially enclosed by ridges 48.

At the junction between walls 46 and wall 28, further walls 50 extend outwardly, normal thereto, and from their free ends two further channel side walls 52 extend at right angles, lying in plane parallel to walls 40.

Walls 50, and 38, together define intermediate channels 54, having open mouths directed outwardly which are partially defined by ridges 56.

Similarly, walls 46, 50 and 52 define downwardly directed channels 58, with open mouths which are partially defined by ridges 60.

The fastening channels 58, and 42, provide longitudinal recesses or channels for fastening of the vinyl fabric.

Two intermediate channels 62–64 are defined respectively by walls 34 and 46, and form further fastening channels, for securing cover strips (described below) in position.

The intermediate channels 54-62-64 also provide a fastening location for the same cover strips in certain other uses described below.

The central box-like junction channel 26 provides a longitudinal recess in the frame pieces by means of which the frame pieces may be joined together.

Throughout the remainder of this disclosure the channels will therefore be referred to as either fastening channels or intermediate channels or junction channels according to their function.

In order to secure the vinyl fabric in the fastening channels, elongated wedging strips 70, typically formed of extruded plastics material such as extruded vinyl plastic or the like. Typically, these wedging strips are provided with a section as illustrated in FIG. 4, although in fact a variety of sectional shapes may be found to be satisfactory for the purpose.

The shape and construction and dimensions of the strips should be such that they will interlock with the ridges 44, or 60, defining the open mouths of the fastening channels.

In one form, the strips 70 may be solid, and formed of resilient material. In another form, the wedging strips may be formed in a generally U-shaped channel design (FIG. 7). Such an alternate form of wedging strip is illustrated in FIG. 7 as strip 70*a*.

The vinyl fabric is fastened in position, by simply placing the wedging strip 70 along the edge of the vinyl strip, some way in approximately an inch or so from the edge and forcing the strip down into its appropriate fastening channel as shown in FIG. 4.

This will usually leave a free edge of vinyl fabric extending out of the fastening channel.

In order to provide an exterior finish, and to hide these exposed edges on the vinyl panel, a cover strip illustrated generally as 72 is provided.

This strip which is again typically an extruded plastics strip, typically of vinyl plastics, preferably has a smoothly convex exterior wall 74, and a pair of U-shaped inner gripping walls 76 having teeth 78 thereon. The walls 76 and teeth 78 are intended to fit within the intermediate channels 54—54 or 62, 64 and interengage with the ridges 56, or 36 or 48 in the manner shown.

In order to secure the frame pieces together, the frame junction members illustrated as either 22 (FIG. 3) or 24 (FIG. 5) may be used.

Referring first of all to FIG. 3, the junction member 22 comprises a pair of clamp members indicated generally as 80 and 82. The clamp member 80 has a pair of channel walls 84, and endwise hook portions 86 provided with recesses 88.

The clamp member 82 has a rectangular ridge portion 90, adapted to make a sliding fit in the walls 84 of the member 80. It also has hook portions 92, and recesses 94. A threaded fastening device 96 having a reduced diameter neck portion 98, is received within an unthreaded opening in the ridge member 90, and is secured therein by means of the locking ring 100.

The threaded end of the fastening member 96 is received in a suitable threaded opening in the member 80.

In this way, by operating the threaded member 96, the two members 80 and 82 can be forced away from one another.

In order to secure a T-shaped junction between the frame pieces, the hook members 86 and 92 are engaged in one of the intermediate channels 54—54 or 62–64. The recess portions 88 and 94 will engage with the ridges extending along the open mouths of these channels.

The opposite ends of the clamp members will be received lengthwise along the length of the other frame member, passing into the open end of the appropriate intermediate channel.

By operation of the threaded device 96, the two clamp members 80 and 82 can be forced apart thereby clamping securely to both frame pieces, and making a good rigid joint.

End butting joints can be formed at right angles, or at a variety of different angles, by means of the junction member 24 (FIG. 5).

This junction member consists of a generally L-shaped elbow, having two fastening arms 102 and 104. The arms 102, 104 meet at a corner 106, which is formed with a reduced thickness in relation to the arms 102, 104, and has a generally V-shaped notch or groove 108 formed on the inside of the corner.

This V-shaped notch 108 permits the two arms to be bent relative to one another through a sufficient angle to permit the fastening of a variety of different angled end abutment engagements, as shown in FIG. 5.

The inwardly facing surfaces of the arms 102-4 are provided with clamping teeth 110. Clamping screws 112, are located in V-shaped notches 114. The screws 112 pass through the arms at an angle, being directed with their axes towards the corner 106.

As shown in FIG. 6, the clamping member 24 may be used at an end abutting corner where the two frame sections make an angle to one another which may be other than a right angle.

The arms 102-4 may be simply bent apart, and slid into junction channels 26 at the two ends of the frame pieces.

The clamping screws 112 are then tightened up, and by virtue of the angled orientation of the screws, they will progressively draw the two ends of the frame pieces tighter and tighter together.

Thus, a good secure form of fastening is provided making a good rigid joint.

As shown in FIGS. 1 and 2, suitable lighting tube 120, mounted on electrical fixtures 122, may be located within the framework, providing interior illumination. A typical louvre 124 may be located in the base of the frame, permitting light to be thrown downwardly.

A modified form of fastening for the fabric panels can comprise a staple receiving solid strip 130 (FIG. 8) having a flat fastening face 132. The strip 130 is secured in the fastening channels, e.g., 42. The fabric can simply be secured to face 132 by staples. Excess fabric can then be concealed in the intermediate channel.

In operation, the frame pieces are cut to length and joined together by the junction members as described.

The vinyl fabric panels are then cut to shape. Typically there will be one vinyl fabric panel piece for the curved front of the awning, and one vinyl fabric piece for either end of the sign and a further vinyl fabric piece for the front planar portion of the awning as illustrated in FIG. 1.

The separate vinyl pieces are not separately referenced.

Typically, the front planar panel will be printed up with graphics, while the remainder of the panel will simply be painted the desired colour.

The panels are then fastened in position, by placing the edges in the fastening channels, and forcing in the wedging pieces 70. The cover strips 74 are then applied concealing the edges of the vinyl panel.

If it is desired to change the graphics on the awning, all that is removed is the front planar portion bearing the graphics, and a new planar portion is placed in position.

It is thus not necessary to disturb the remainder of the vinyl panel pieces.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. An awning having a modular frame and comprising;

a plurality of frame pieces, defining pairs of parallel longitudinal fastening channels defining a spacing therebetween;

an interior longitudinal junction channel formed along each said frame piece, said junction channel being located in a plane lying between said parallel fastening channels and offset to one side of said fastening channels;

an access opening defined by said junction; channel for access thereto from the exterior of said frame piece;

connecting means in said junction channels of adjacent said frame pieces connecting adjacent said frame pieces together in abutting relation;

adjustable locking means operable through said access opening from the exterior of said frame pieces;

flexible plastic panel means adapted to be stretched over said composite frame and fastened in said fastening channels, and, elongated flexible wedging strips shaped and adapted to be force fitted into said recesses together with portions of said flexible panel means thereby wedging said portions of said flexible panel means in said channels and securing the same.

2. An awning as claimed in claim 1 wherein said frame defines an information area, and frame portions around said information area, on all four sides, and including at least two flexible plastic panels, one said panel being dimensioned to fit on said information area, and the other said panel being shaped to fit over the remainder of said frame, thereby permitting replacement of said one panel without disturbing the remainder.

3. An awning as claimed in claim 1 wherein said frame pieces define further intermediate channels between said two continuous spaced apart longitudinal fastening channels formed therealong in parallel relation.

4. An awning as claimed in claim 3 including a cover strip adapted to extend over said fastening channels, and flange means thereon insertable into said intermediate channel.

5. An awning as claimed in claim 1 wherein said connecting means include tongue portions insertable into said junction channels.

6. An awning as claimed in claim 1 wherein said frame pieces define a common cross-section having four parallel spaced apart wall means on a first side thereof, defining three spaced apart parallel channels, a further four parallel spaced apart walls, defining a further three channels, on a second side of said frame pieces opposite to said first side, and, wherein said frame pieces define a generally four sided rectangular shape, in section, with said first and second sides opposite to one another, and including further side channels formed in the third and fourth sides thereof, and wherein said junction channel is located between said further side channels in said third and fourth sides.

* * * * *